US007513083B2

(12) United States Patent
Pryor et al.

(10) Patent No.: US 7,513,083 B2
(45) Date of Patent: Apr. 7, 2009

(54) ROTATING CONCENTRIC HOLDOWN

(75) Inventors: Steven E. Pryor, Dublin, CA (US); Ricardo Arevalo, La Verne, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 250 days.

(21) Appl. No.: 10/920,470

(22) Filed: Aug. 17, 2004

(65) Prior Publication Data

US 2006/0053714 A1 Mar. 16, 2006

(51) Int. Cl.
*E04B 1/21* (2006.01)

(52) U.S. Cl. ..... 52/167.4; 52/296; 52/298; 52/127.7; 52/295; 403/232.1; 403/237

(58) Field of Classification Search ..... 52/592.2, 52/592.4, 592.1, 591.3, 591.1, 589.1, 295, 52/296, 297, 298, 712, 127.7, 127.12, 293.3, 52/167.1, 167.4, 167.5, 573.1; 403/232.1, 403/237; 248/188.1, 598, 638, 677, 679, 248/678, 177.1, 187.1, 548, 900; 384/36, 384/154; 256/65.04

See application file for complete search history.

(56) References Cited

U.S. PATENT DOCUMENTS

| | | | | |
|---|---|---|---|---|
| 573,452 | A | 12/1896 | Delahunt | |
| 967,107 | A | 8/1910 | Cook et al. | |
| 1,335,617 | A | 3/1920 | Solomon | |
| 1,503,148 | A | 7/1924 | Bernstrom | |
| 1,578,947 | A | 3/1926 | Alber | |
| 1,696,288 | A | 12/1928 | Underwood | |
| 2,169,474 | A | 8/1939 | Pederson | |
| 2,227,713 | A | 1/1941 | Higgins | |
| 2,321,221 | A | 6/1943 | Linehan | |
| 3,108,664 | A * | 10/1963 | Vawter | 52/296 |
| 3,413,773 | A | 12/1968 | Fitzgerald | |
| D224,083 | S | 7/1972 | Gilb | |
| 4,096,677 | A | 6/1978 | Gilb | |
| 4,192,118 | A | 3/1980 | Gilb | |
| 4,199,908 | A | 4/1980 | Teeters | |
| 4,321,776 | A | 3/1982 | Delight | |

(Continued)

FOREIGN PATENT DOCUMENTS

| | | |
|---|---|---|
| DE | 1205686 | 11/1965 |

(Continued)

OTHER PUBLICATIONS

Hughes Manufacturing, Inc., "Product Catalog 1996/1997," Heavy Hold Downs, Hughes Manufacturing, Inc., Lagro, Florida, p. 41 (1996).

(Continued)

*Primary Examiner*—Robert J Canfield
*Assistant Examiner*—Jessie Fonseca
(74) *Attorney, Agent, or Firm*—James R. Cypher; Charles R. Cypher

(57) ABSTRACT

A connection between a wall stud or post and an anchor bolt embedded in a concrete foundation, using a holdown connector that attaches to the anchor bolt and supports the wall stud or post above it. The holdown connector has a tapered bottom that allows it to rotate laterally, allowing the connection to act more purely in tension than is possible with a rigid connection.

16 Claims, 13 Drawing Sheets

U.S. PATENT DOCUMENTS

| | | | | |
|---|---|---|---|---|
| 4,367,864 | A | | 1/1983 | Eldeen |
| 4,387,543 | A | | 6/1983 | Tschan et al. |
| 4,480,941 | A | | 11/1984 | Gilb et al. |
| 4,530,194 | A | | 7/1985 | Linton et al. |
| 4,587,788 | A | | 5/1986 | Bielicki |
| 4,603,531 | A | | 8/1986 | Nash |
| 4,614,070 | A | | 9/1986 | Idland |
| 4,665,672 | A | | 5/1987 | Commins |
| 4,717,279 | A | | 1/1988 | Commins |
| 4,744,192 | A | | 5/1988 | Commins |
| 4,825,621 | A | | 5/1989 | Jensen |
| 4,869,467 | A | | 9/1989 | Kellison |
| 4,875,314 | A | | 10/1989 | Boilen |
| 4,890,436 | A | | 1/1990 | Colonias |
| 4,924,648 | A | | 5/1990 | Gilb et al. |
| 4,995,206 | A | | 2/1991 | Colonias et al. |
| 5,092,097 | A | | 3/1992 | Young |
| 5,104,252 | A | | 4/1992 | Colonias |
| 5,212,919 | A | | 5/1993 | Shaw et al. |
| 5,249,404 | A | | 10/1993 | Leek |
| 5,301,485 | A | | 4/1994 | Shaw et al. |
| 5,303,520 | A | | 4/1994 | Gozdziak |
| 5,307,603 | A | | 5/1994 | Chiodo |
| 5,333,435 | A | | 8/1994 | Leek |
| 5,375,384 | A | | 12/1994 | Wolfson |
| 5,380,116 | A | | 1/1995 | Colonias |
| 5,384,993 | A | | 1/1995 | Phillips |
| 5,410,854 | A | | 5/1995 | Kimmell et al. |
| 5,467,569 | A | | 11/1995 | Chiodo |
| 5,467,570 | A | | 11/1995 | Leek |
| 5,501,048 | A | | 3/1996 | Nakanishi |
| 5,531,054 | A | | 7/1996 | Ramirez |
| 5,535,561 | A | | 7/1996 | Schuyler |
| 5,540,530 | A | | 7/1996 | Fazekas |
| 5,570,549 | A | | 11/1996 | Lung et al. |
| 5,575,130 | A | | 11/1996 | Chiodo |
| 5,603,580 | A | | 2/1997 | Leek et al. |
| 5,666,774 | A | | 9/1997 | Commins |
| 5,706,626 | A | | 1/1998 | Mueller |
| D399,013 | S | | 9/1998 | Nguyen |
| 5,832,679 | A | | 11/1998 | Roth |
| 5,901,525 | A | * | 5/1999 | Doeringer et al. ..... 52/736.4 |
| 5,979,130 | A | | 11/1999 | Gregg et al. |
| 5,987,828 | A | | 11/1999 | Hardy |
| 6,015,138 | A | | 1/2000 | Kohlberger et al. |
| 6,067,769 | A | | 5/2000 | Hardy |
| 6,112,495 | A | | 9/2000 | Gregg et al. |
| 6,141,928 | A | | 11/2000 | Platt |
| 6,158,188 | A | | 12/2000 | Shahnazarian |
| 6,513,290 | B2 | | 2/2003 | Leek |
| 6,523,321 | B1 | | 2/2003 | Leek et al. |
| 6,668,508 | B2 | | 12/2003 | Boone et al. |
| 2001/0002529 | A1 | | 6/2001 | Commins et al. |

FOREIGN PATENT DOCUMENTS

| | | |
|---|---|---|
| DE | 9312522 U1 | 12/1993 |
| WO | WO 02/44486 A1 | 6/2002 |

OTHER PUBLICATIONS

Southeastern Metals Manufacturing Co., Inc., "Construction Hardware," Southeastern Metals Manufacturing Co., Inc., Jacksonville, Florida, p. 38 (1991).

BMF-Simpson GMBH, "Statische Werte," BMF-Simpson GmbH (Syke, Germany), p. 54 (2002).

Simpson Strong-Tie Company, Inc., "Wood Construction Connectors," Catalog C-2002, Simpson Strong-Tie Company, Inc., Dublin, California, p. 17 (2001).

Simpson Strong-Tie Company, Inc., "Wood Construction Connectors," Catalog C-2004, Simpson Strong-Tie Company, Inc., Dublin, California, pp. 26-31, 34-38, 44, 45, 48, 49, 128, 141, and 157 (2003).

Tanaka, "House Materials" Product Catalog 2003. Tanaka Co.,Ltd. Japan. p. 82 (2003).

"HD Holdown." Simpson Strong-Tie Company, Inc. catalog, 1966, p. 13.

"HD Holdown." Simpson Strong-Tie Company, Inc. catalog, 1967, p. 13.

"HD Holdown." Simpson Strong-Tie Company, Inc. catalog, 1968, p. 9.

"HD Holdown." Simpson Strong-Tie Company, Inc. catalog, 1970, p. 16.

"HDN Holdowns.""HD Holdowns" Simpson Strong-Tie Company, Inc. catalog, 1979, p. 5.

"HD/HDN Holdowns." Simpson Strong-Tie Company, Inc. catalog, 1983, p. 7.

"HDA Holdowns." *Connectors for Wood Construction*, Simpson Strong-Tie Co. catalog, 1986, p. 7.

"HDA/HD Holdowns." *Connectors for Wood Construction*, Simpson Strong-Tie Co. catalog, 1990, p. 9.

"HDA/HD Holdowns." Simpson Strong-Tie Co., catalog, 1993, p. 13.

"ES Report PFC-5929. TJ-Shear Panel." ICBO Evaluation Service, Inc. Whittier, California. Reissued Nov. 1, 2002.

*Wood Construction Connectors*, Catalog C-2000, Simpson Strong-Tie Co., Inc. Pleasanton, Calif., p. 31-36 (1999).

"USP Lumber Connectors PHD and UPHD Series Hold-downs," ES Report ER-5830, ICBO Evaluation Service, Inc., Whittier, Calif. (Oct. 1, 2001).

"Hardy Frame, Hardy Frame Heavy Duty, 18-inch Hardy Braced Frame and Hardy Frame Screw," Evaluation Report PFC-5342, ICBO Evaluation Service, Whittier, Calif., (Sep. 1, 1999).

"Descriptions and Typical Installation Details. The Hardy Frame. Based on ICBO Approval #PFC-5342", Simplified Structural Systems, Ventura, Calif. pp. H-1-H4 (Dec. 1, 1999).

"The Hardy Frame," The Hardy Frame, Publisher Unknown (US), pp. 1-4.

"Simplified Structural Systems. Makers of the Hardy Frame," Product brochure. Simplified Structural Systems, Ventura, Calif.

"Recommendation for the 18" Hardy Frames,", Simplified Structural Systems, Ventura, Calif. 3 page.

* cited by examiner

ROTATING CONCENTRIC HOLDOWN

BACKGROUND OF THE INVENTION

The present invention relates to a connector for anchoring a first building structural member to a second building structural member. The connector works in conjunction with a separate anchor member that is received or attached to the second building structural member and with fasteners for attaching the connector to the first building structural member.

Earthquakes, hurricanes, tornadoes and floods all impose forces on a building that can cause structural failure. To counteract these forces, it has become common practice to add or strengthen ties between the structural members of a building in the area of the building where these cataclysmic forces may be concentrated. For example, framed walls can be connected to the foundation rather than merely rest on it. Connections between the framed walls of each floor can be strengthened. And joists can be connected to both their headers and the walls that support the headers. One of the most common connectors designed for these applications is commonly called a holdown. Holdowns are commonly used to anchor framed walls to the foundation. Holdowns restrain wall posts or studs against uplift, particularly uplift at the ends of shear walls that occurs as a result of lateral loads being applied to the top of the shear wall. When lateral loads, such as may be caused by earthquakes and high wind, are applied to the top of a shear wall, the shear wall tends to overturn rather than collapse, because it is reinforced against lateral shear loads. The overturning moment tends to lift the trailing side of the shear wall.

Early holdowns were constructed from two or more separate pieces of metal that were welded together. Welded holdowns had to be painted to prevent rust. They were heavy and costly to produce, in particular because of the additional labor involved in welding and painting.

State of the art holdowns are made from galvanized sheet metal formed on progressive die machines. Recently, strong and light cast materials such as aluminum have also been used. Ideally, state of the art holdowns require no welding or painting. These advances have reduced the cost of making holdowns while increasing their ability to withstand tension forces. Severe earthquakes in California and Japan demonstrated that holdowns that are capable of being mass-produced and installed inexpensively should be made even stronger for many connections.

Typical holdowns work in conjunction with a separate anchor member and are attached to the side face of the first building structural member, which is generally a vertically-disposed wall stud. In these holdowns that attach to the side of a stud or post, the anchor member is attached at the seat of the connector. The seat is connected to a back member and the back member attaches to the side face of the stud or post. Often, these holdowns have one or more side members to increase the strength of the connector or to connect the seat member to the back member.

Another style of holdown attaches to the bottom end of the stud or post. A patented example of this type of holdown is found in U.S. Pat. No. 6,513,290, granted to William F. Leek on Feb. 4, 2003. The advantage of a holdown that attaches to the bottom end of a post or stud is that it can remove any eccentricity from the connection. Eccentric connections introduce bending stresses into the post or stud. Thus, as a shear wall moves back and forth under shear loads, the post or stud attempts to rotate about its base. Prior art holdowns, as described above, do not allow post rotation at the bottom, and bending stresses are introduced into the post above the holdown during shear wall movement. Concentric holdowns tend to allow a degree of lateral rotation because the holdown and the supported post are in line with the anchor bolt and the axis of rotation is generally on that line. The point at which the holdown is restrained to the anchor bolt is where rotation will tend to occur, if rotation is possible. Prior art holdowns, however, have not allowed rotation to occur at that point, but have instead permitted bending in the wood post at the juncture of the top of the holdown and the supported post. Eccentric holdowns tend to resist rotation in one direction only because they are attached to one side of the post and therefore to one side of the natural axis of rotation. In the present invention, the axis of rotation is below the post or stud and immediately below the point at which the holdown is restrained to the anchor bolt.

The present invention improves on the prior art by lowering the axis of rotation below the top of the anchor member that connects the holdown to the second structural member, or foundation. It is advantageous to have the axis of rotation as low as possible. Under gravity loads, the post pushes down on the concentric holdown below it along a load line of action. When the post is perfectly vertical, the load line of action passes through the middle of the holdown. When the post is rotated and compressed, as under racking deformation during an earthquake, the load line of action follows the line of the post and the projection point at which it intersects the underlying structural member moves away from the center of the holdown base. The higher the axis of rotation, the further the line of action moves for any given degree of rotation. If the line of action moves beyond the holdown base, the holdown base will tend to be pushed over because the top of the holdown base will be pushed toward a point beyond the bottom of the holdown base. Although the holdown base will tend to be pushed over, it is restrained, primarily by the anchor bolt. As the load line of action moves away from the center of the holdown, the compression stresses on the underlying structural member become increasingly non-uniform. This is undesirable because it tends to rupture the progressively bending upright post member and to damage the underlying structural member, usually a concrete foundation, which both supports and anchors the structure above it. The present invention lowers the axis of rotation so that the load line of action passes through the holdown base substantially away from its edges, keeping the bearing stresses on the underlying structural member as uniform as possible.

Recently, it has become apparent that simply increasing the strength of holdowns does not necessarily result in the best connection for the most common installation, between a frame wall reinforced for shear resistance and a concrete foundation. The greater the simple strength of the holdown, the more rigid its connection. It is possible to design and manufacture holdowns that are so strong and rigid that failure is bound to occur elsewhere in the connected structure, such as in the load bearing wood member above the holdown. By transferring failure entirely out of the holdowns, the risk of catastrophic failure of the connected structure is increased. It has therefore become desirable to design holdowns that maximize resistance to uplift forces, but which allow a small amount of rotation to occur at the connection to the second structural member or foundation.

The present invention improves on the prior art by allowing for rotation as close as possible to the point of attachment to the underlying structure. This means that there will be very little bending in the post or stud to which the holdown of the present invention is attached. This allows the post or stud to be smaller and of a lower stress grade. Because the post or stud bends very little, the attachment of the post or stud to a shear-resisting member, particularly to a panel by many small fasteners such as nails, works better, distributing and dissipating shear forces more evenly and effectively throughout the panel. This results in more gradual and predicable failure. The holdown of the present invention provides a hinge joint at the base of the holdown that improves on prior art rigid holdowns that raised the axis of rotation and tended to transmit additional tension forces into the anchor bolt when the shear panels levered up on their lateral corners. Without the hinge of the present invention, the tension forces acting on the anchor bolt and the prior art holdown are greater than the uplift force of the post or stud alone when the post is subject to an overturning moment. When prior art eccentric or concentric rigid holdowns resist post or stud rotation, additional tension forces are created in the anchor bolt.

The most preferred form of the present invention is superior to prior art rotating concentric holdowns because the present invention does not rely on a relatively weak horizontal pin connection for both rotation and the transfer of both post uplift forces (by shear) and compression forces (due to gravity or overturning moment) between vertical plates embedded in the post or stud and a base that is connected to the anchor bolt. The present invention transfers compression forces by direct bearing of one contact surface on another, as in the most preferred embodiment in which a standoff base and channel slide between the bottom surface of a floating washer and the upper surface of a support base, from post to standoff base to strap to support base to foundation. The present invention transfers uplift forces directly to the anchor bolt in tension (aside from the post to strap connection). In its most preferred embodiment, the present invention achieves rotation with sliding surfaces rather than a pin connection that, if damaged or bent, could lead to failure of the gravity load system or rotation system.

The holdown connector of the present invention improves on the prior art by providing a holdown that withstands very high tension loads with minimal deflection, while allowing for rotation about an axis lower than the top of the anchor member, and being economical to produce.

SUMMARY OF THE INVENTION

The present invention is a connection between a wall stud or post and an anchor bolt embedded in a concrete foundation, using a holdown connector that attaches to the anchor bolt and supports the wall stud or post above it. The holdown connector has a tapered bottom that allows it to rotate laterally, allowing the connection to act more purely in tension than is possible with a rigid connection.

An object of the present invention is to reduce bending moments in the wood wall stud or post at the juncture of the top of the holdown connector and the wall stud or post.

The present invention is a connection with a support base that provides a bearing surface that the bottom of the connector can move against instead of the underlying foundation.

The present invention is a connector with substantially arcuate, or curvilinear, tapering portions which allow the connector to rotate more smoothly than with angularly tapering portions.

The present invention is a connection in which the tapered support surface of the support base conforms to the registering tapered portions of the connector, allowing the connector to rotate smoothly against the support base.

The present invention is a connection in which the connector slides smoothly on the support base below it, accommodating rotating through matched slip surfaces rather than a pin connection or deformation of the holdown connector.

The present invention is a connector with a channel that encloses and supports a standoff base that, in turn, supports the wall stud or post.

The present invention is a connection in which the wall stud or post is inserted between the upright arm of the channel and stands on the upper surface of the standoff base. The sides of the channel are connected to the wall stud or post with fasteners such as nails, screws or bolts. The sides of the channel include fastener openings.

The present invention is a connector in which the support base is a flat-bottomed plate than rests on the planar concrete foundation surface.

The present invention is a connector that has a standoff base that is made with an upper portion, an open portion and a lower portion, the upper portion being open to permit access to the top of the anchor bolt, which comes up through the bottom and terminates in the open portion below the supported wall stud or post, which stands on the upper portion. The open portion has two sides that connect the top and bottom portions and elevate and support the wall stud or post.

The present invention is a connector with a channel that has a back member, so that the supported wall stud or post is enclosed on three sides. The back member is then connected to the wall stud or post with fasteners.

The present invention is a connector with a floating washer that rests on the inner bottom surface of the standoff base and remains level when the rest of the connector and the wall stud or post rotate. The floating washer slides, but remains in full bearing contact with the inner bottom surface of the standoff base. The anchor bolt comes up through the channel, the standoff base and the floating washer, and is restrained on top of the floating washer.

The floating washer has a substantially arcuate bottom that matches the substantially arcuate bottoms of both the standoff base and the channel, providing surfaces that ideally are sections of circles around the axis of rotation.

The anchor bolt openings in the standoff base and the channel are laterally oversized to allow the standoff base and channel to rotate, sliding relative the support base and the floating washer while the support base and floating washer remain level and relatively static.

Thus, as the wood post or stud rotates, only a minimal bending force in transmitted to the vertical anchor bolt in the concrete foundation.

DETAILED DESCRIPTION OF THE INVENTION

Figure 1A:
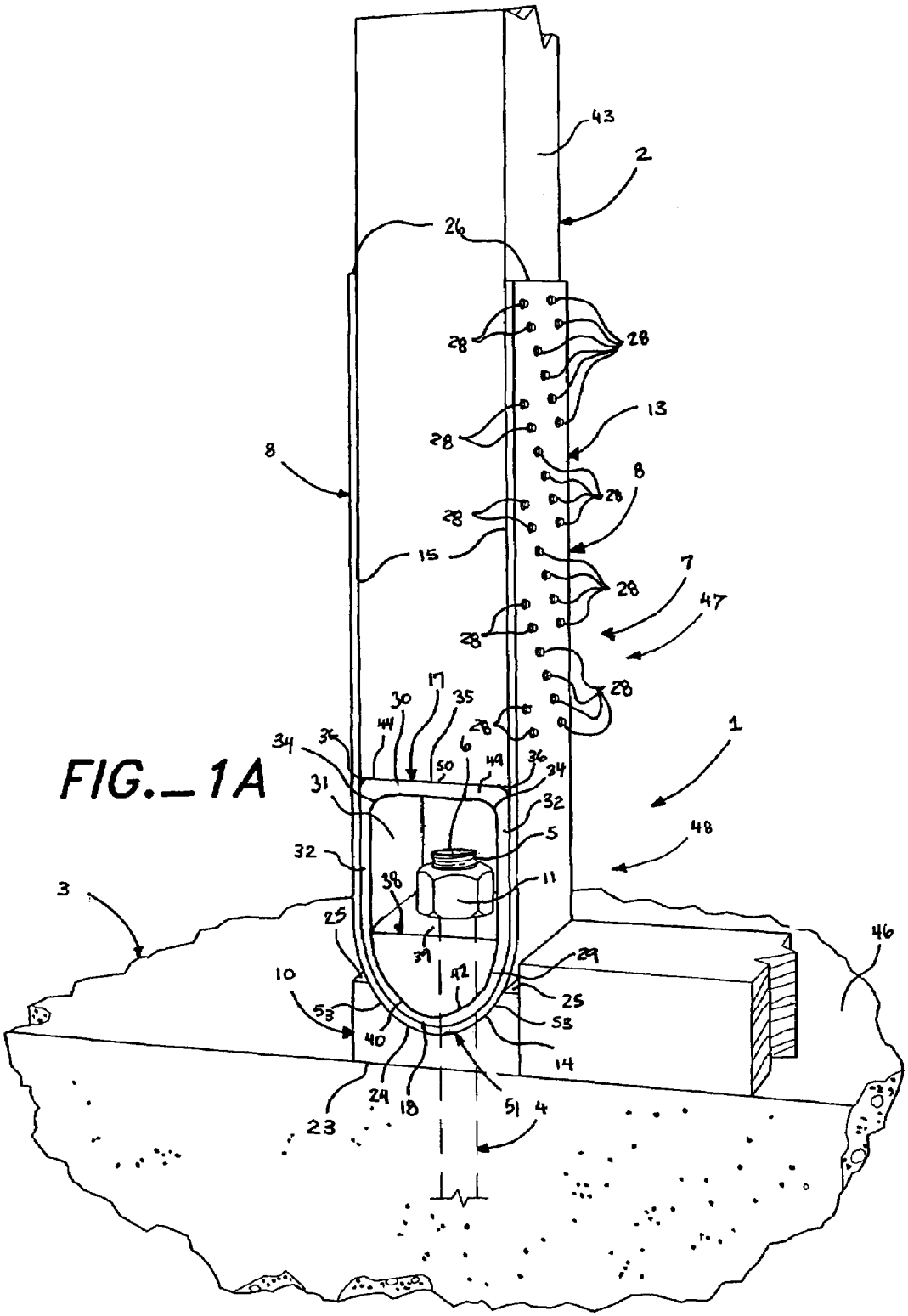
FIG. 1A is a perspective view the connection of the present invention.
Figure 1B:
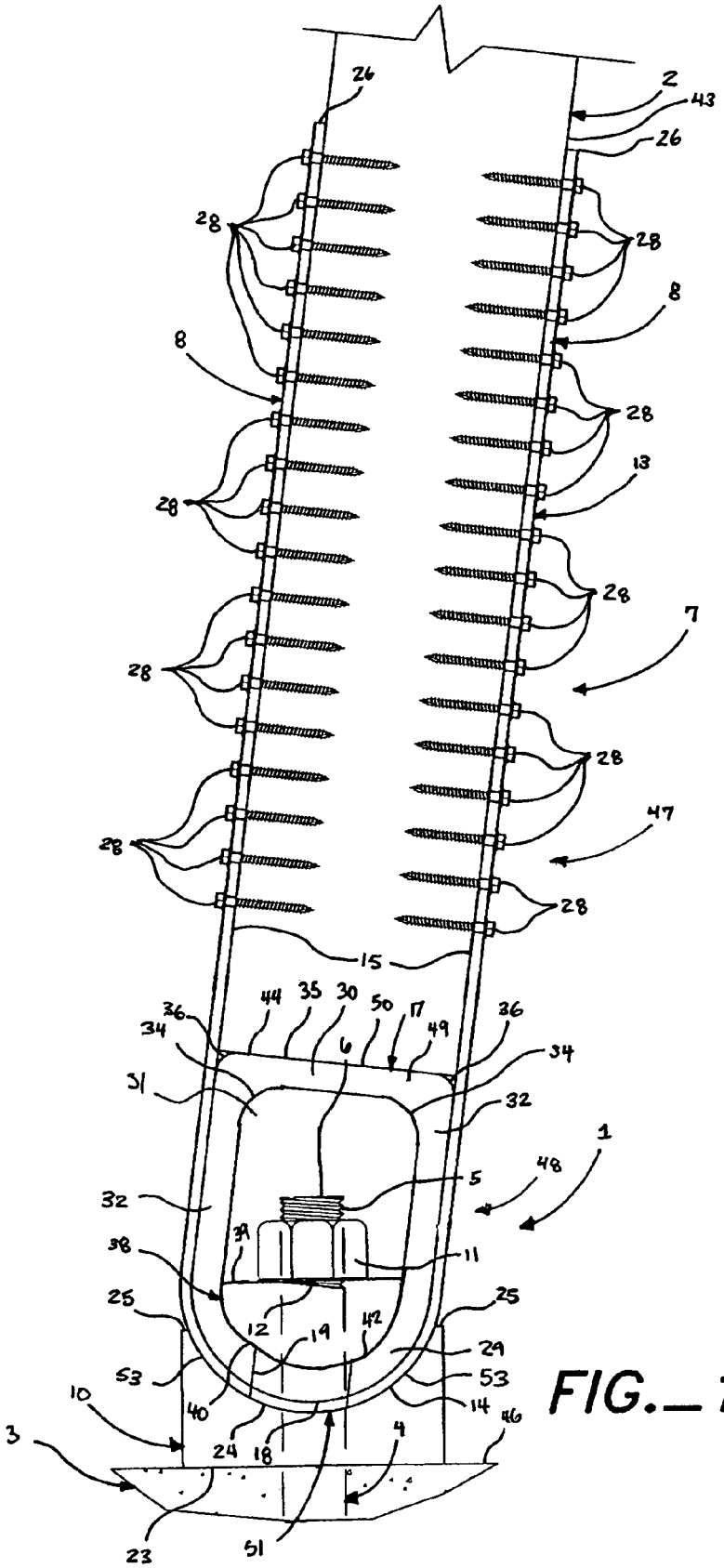
FIG. 1B is a partial cross-section and front elevation view of the connection of the present invention showing rotation of the connector of the present invention about an axis due to the imposition of lateral forces on the connector.
Figure 2:
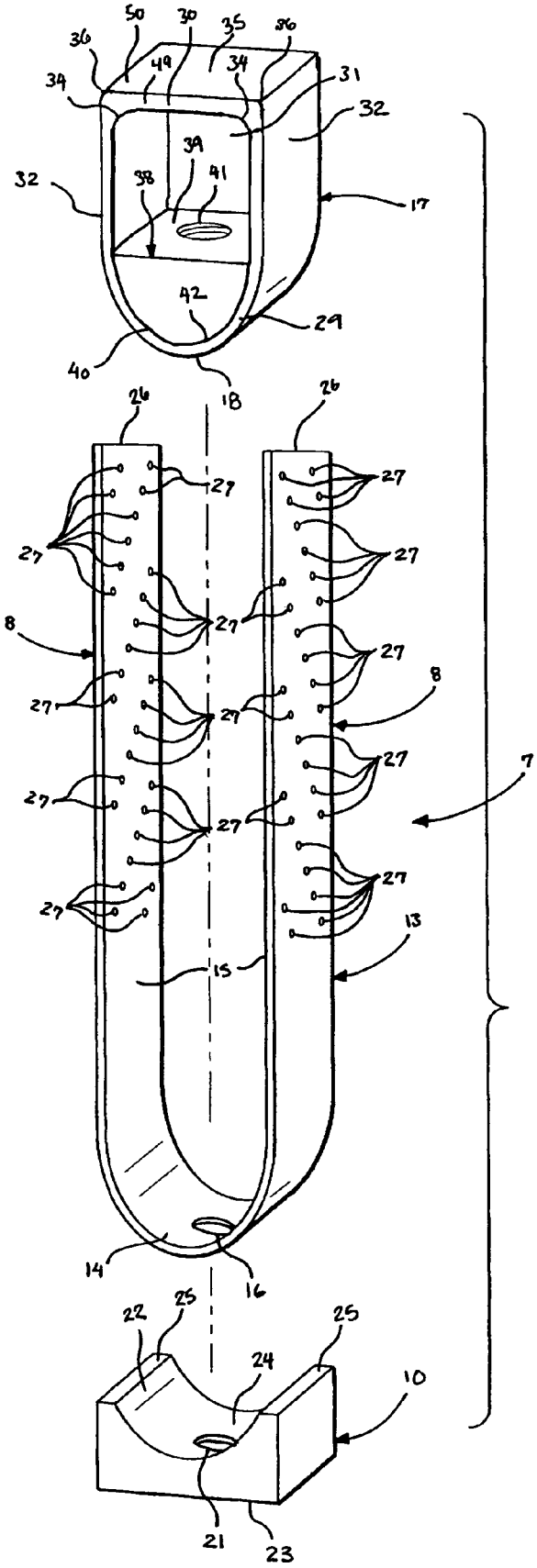
FIG. 2 is an exploded perspective view of a connector constructed in accordance with the present invention.
Figure 3:
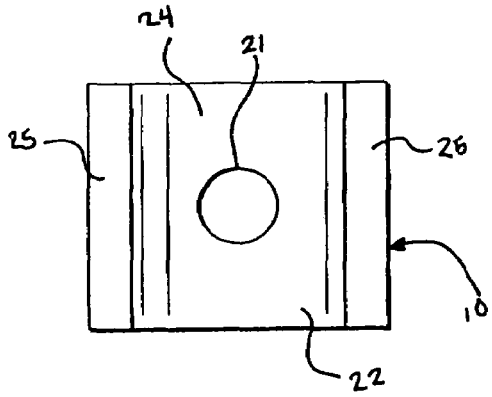
FIG. 3 is a top plan view of the support base of the connector of the present invention.
Figure 4:
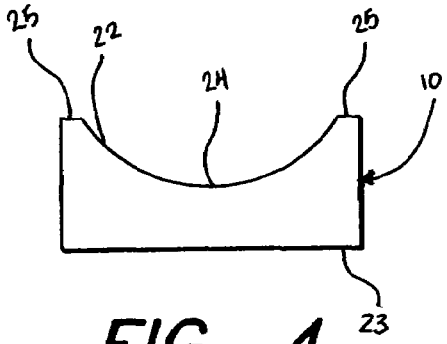
FIG. 4 is a front elevation view of the support base of the connector of the present invention.
Figure 5:
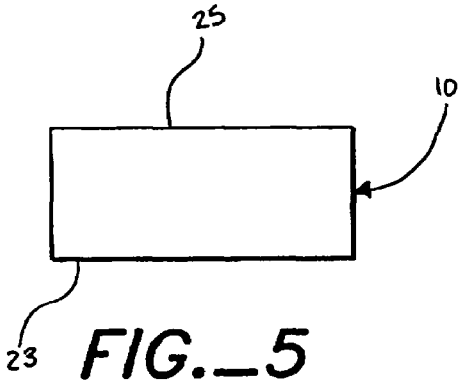
FIG. 5 is a side elevation view of the support base of the connector of the present invention.
Figure 6:
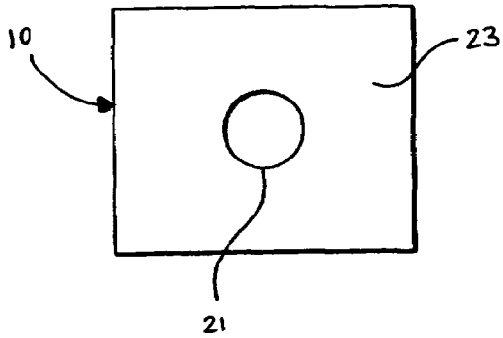
FIG. 6 is a bottom plan view of the support base of the connector of the present invention.
Figure 7:
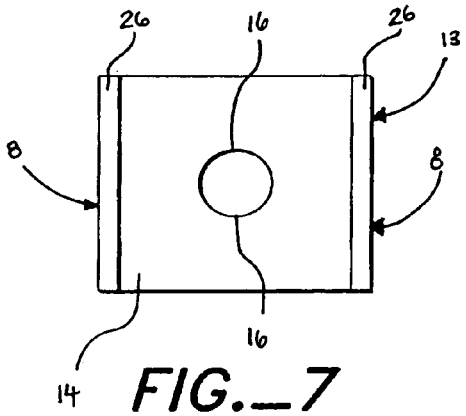
FIG. 7 is a top plan view of the channel of the connector of the present invention.
Figure 8:
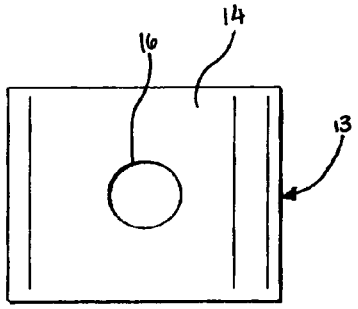
FIG. 8 is a bottom plan view of the channel of the connector of the present invention.
Figure 9:
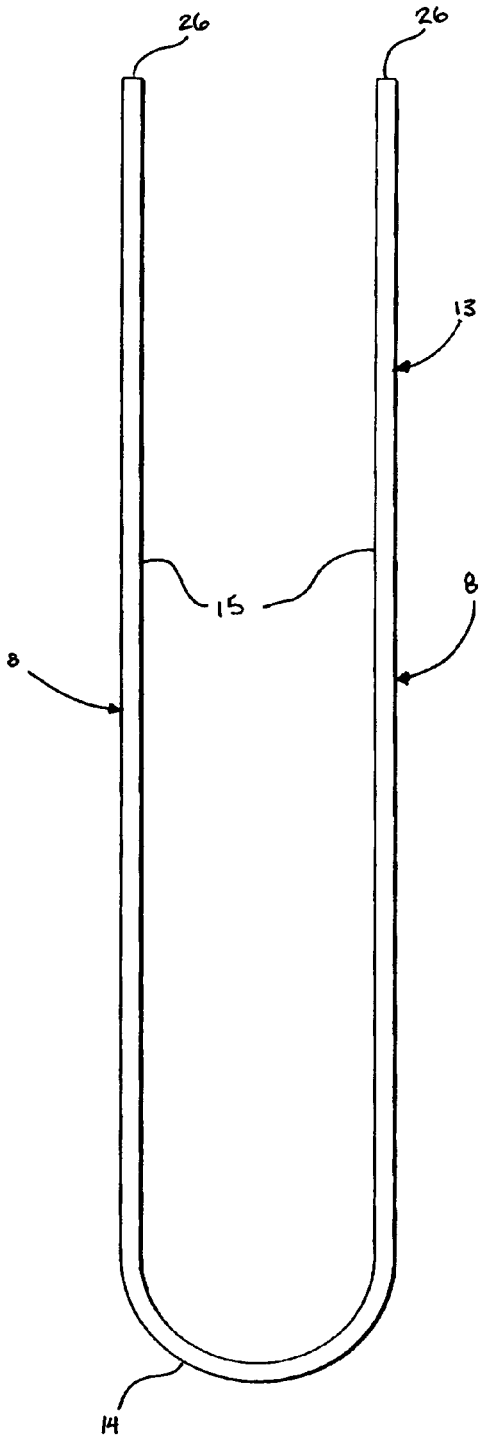
FIG. 9 is a front elevation view of the channel of the connector of the present invention.
Figure 10:
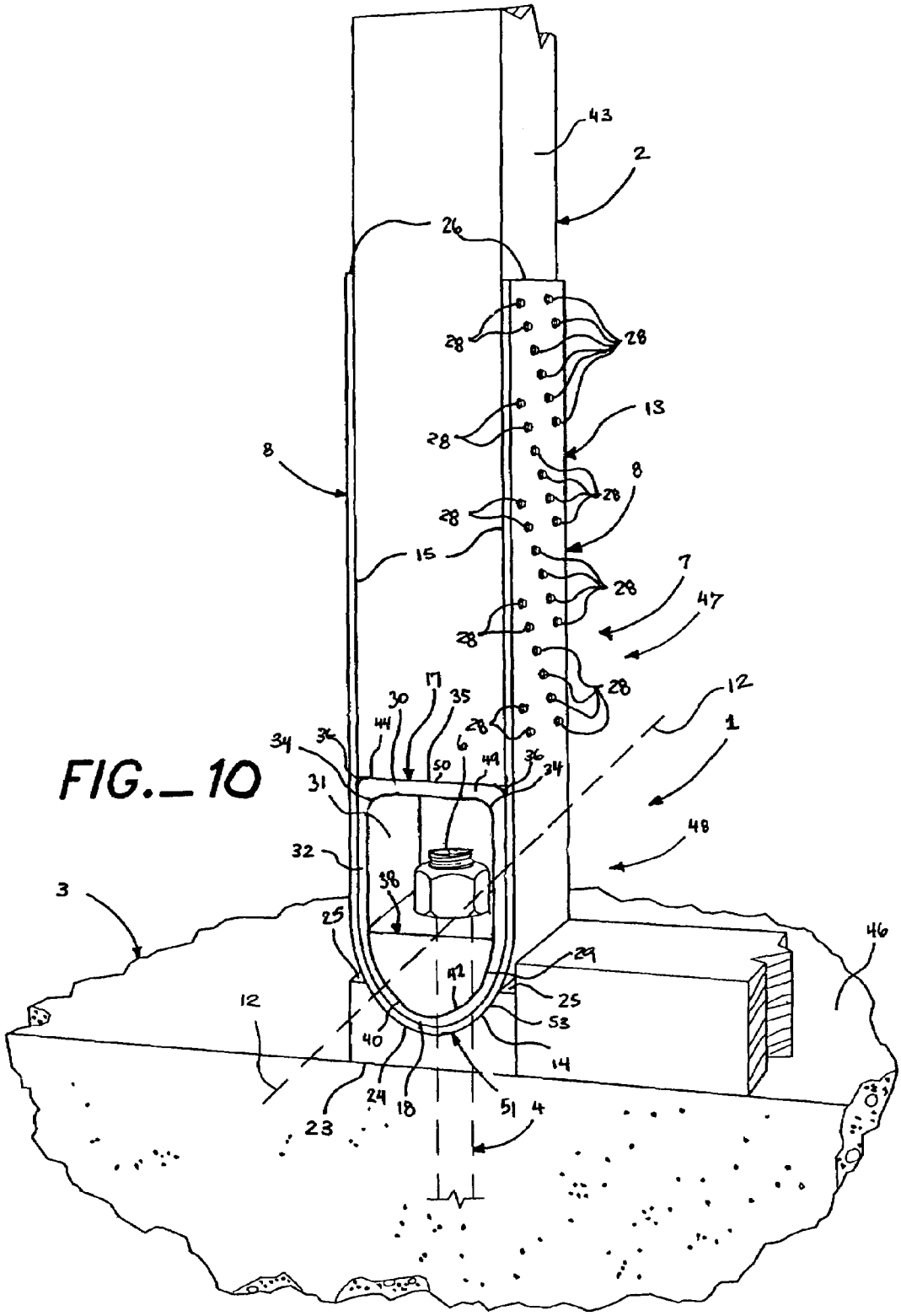
FIG. 10 is a perspective view of the connection of the present invention showing the axis of rotation.
Figure 11:
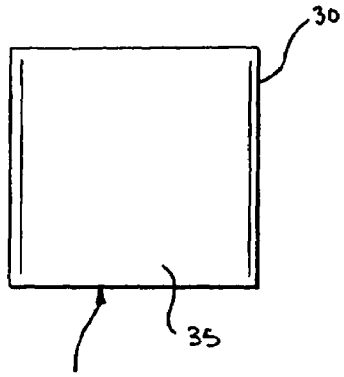
FIG. 11 is a top plan view of the standoff base of the connector of the present invention.
Figure 12:
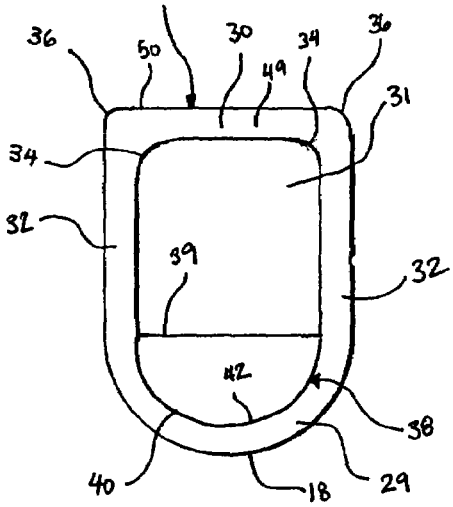
FIG. 12 is a front elevation view of the standoff base of the connector of the present invention.
Figure 13:
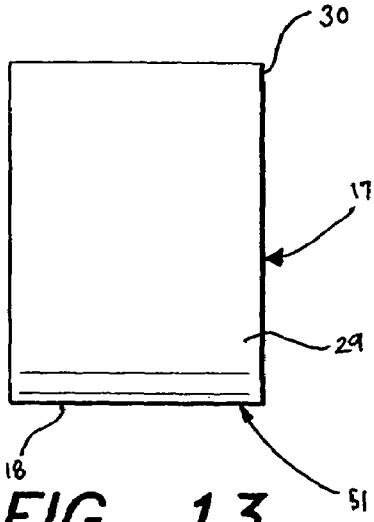
FIG. 13 is a side elevation view of the standoff base of the connector of the present invention.

As shown in FIGS. 1A, 1B, 10 and 15A-19, the present invention is a building connection 1 including a first building structural member 2, a second building structural member 3, a first anchor member 4, and a connector 7 that receives the first end portion 5 of the first anchor member 4. As shown in FIGS. 1B, 10 and 15B, the connection 1 has an axis of rotation 12 and the axis of rotation 12 is below the first end 6 of the first anchor member 4.

Figure 19:
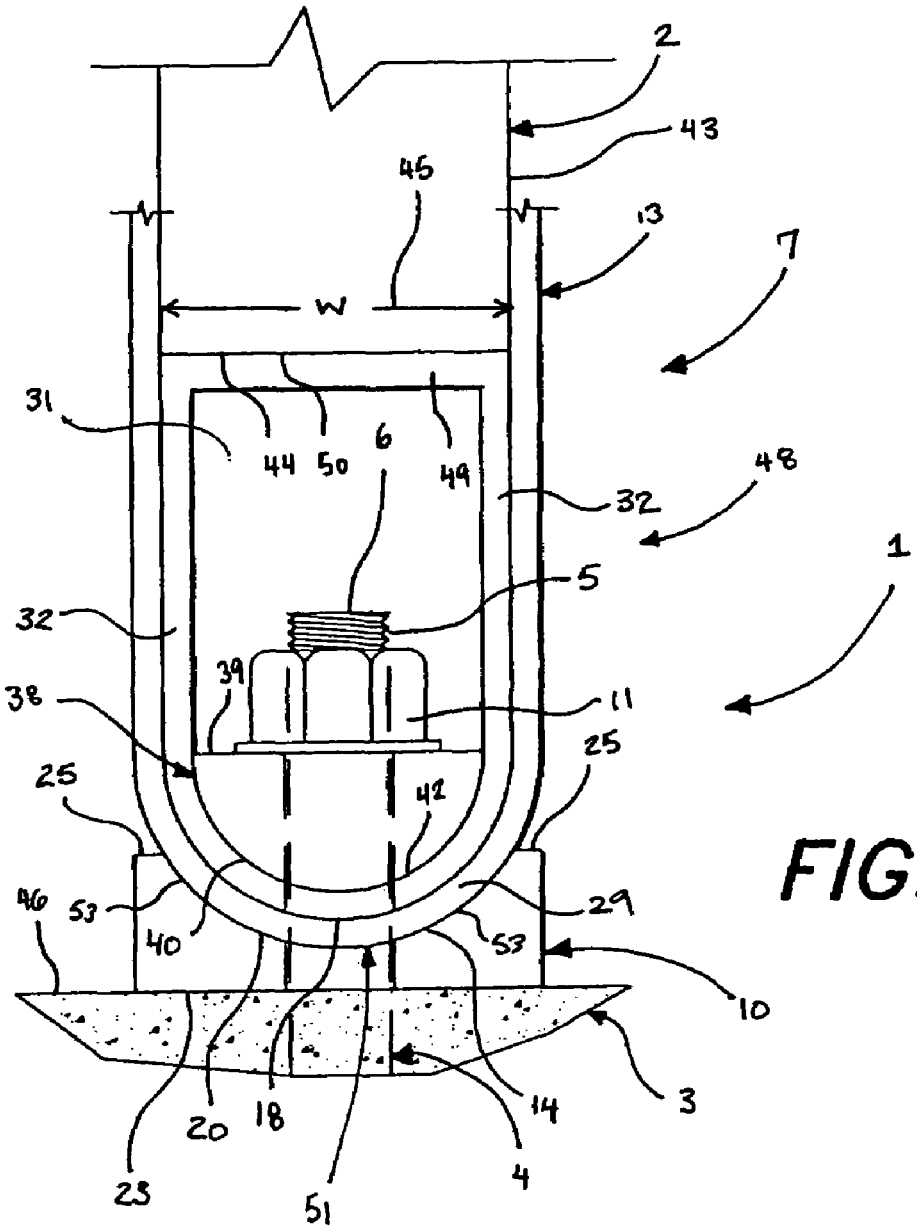
FIG. 19 is an enlarged front elevation view of the connector of the present invention showing the standoff base inserted into the strap without any rotation.

The first building structural member 2 includes a first side face 43 and a bottom end 44, the bottom end 44 having a width 45, as shown in FIG. 19. The second building structural member 3 includes an upper surface 46 that supports the first building structural member 2. The first anchor member 4 is restrained by the second building structural member 3; the first anchor member 4 further includes a first end portion 5 extending from the second building structural member 3 and a first end 6.

The connector 7 includes an upper portion 47 and a lower portion 48, at least partially located between the bottom end 44 of the first building structural member 2 and the upper surface 46 of the second building structural member 3.

The upper portion 47 includes a first structural attachment member 8, the first structural attachment member 8 including a first side 15 that is attached to the first side face 43 of the first building structural member 2.

Figure 23:
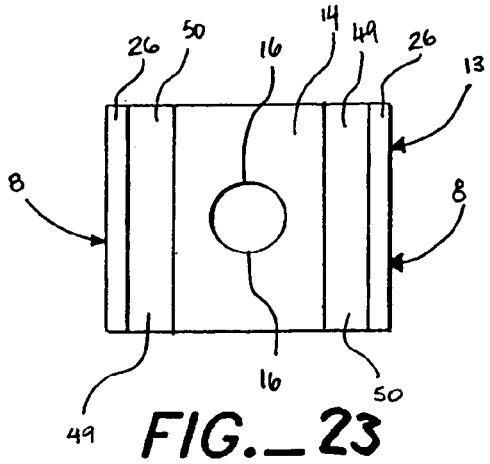
FIG. 23 is a top plan view of the channel of the connector of the present invention having an integral standoff member.
Figure 24:
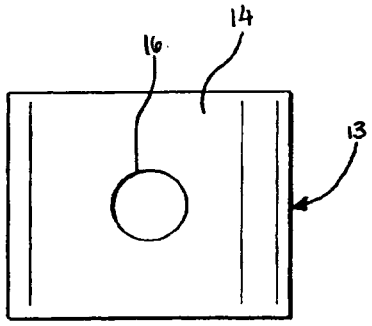
FIG. 24 is a bottom plan view of the channel of the connector of the present invention having an integral standoff member
Figure 25:
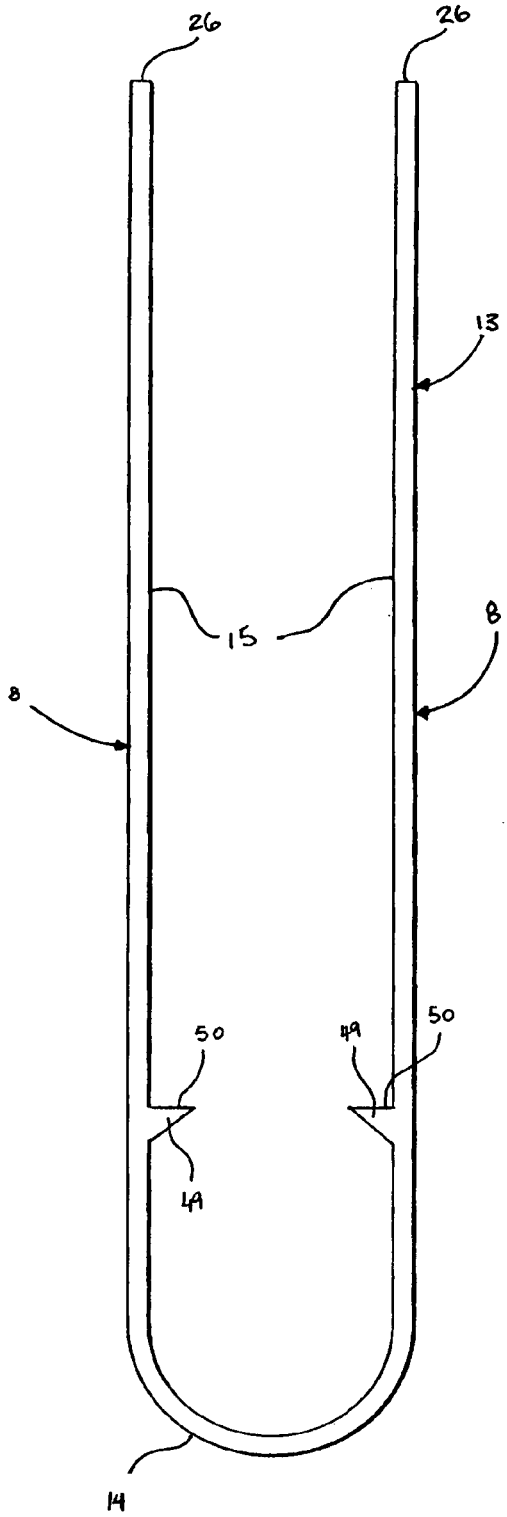
FIG. 25 is a front elevation view of the channel of the connector of the present invention having an integral standoff member.

The lower portion 48 further includes a first standoff member 49, a first anchor attachment member 11, and a bottom portion 51 located between the bottom end 44 of the first building structural member 2 and the upper surface 46 of the second building structural member 3 and not extending beyond the width 45 of the bottom end 44 of the first building structural member 2. As shown in FIGS. 23 and 25, the first standoff member 49 can an integral support.

Figure 14:
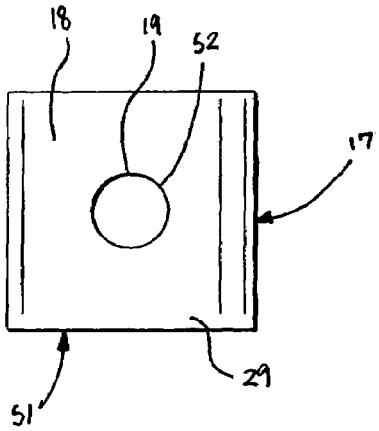
FIG. 14 is a bottom plan view of the standoff base of the connector of the present invention.
Figure 15A:
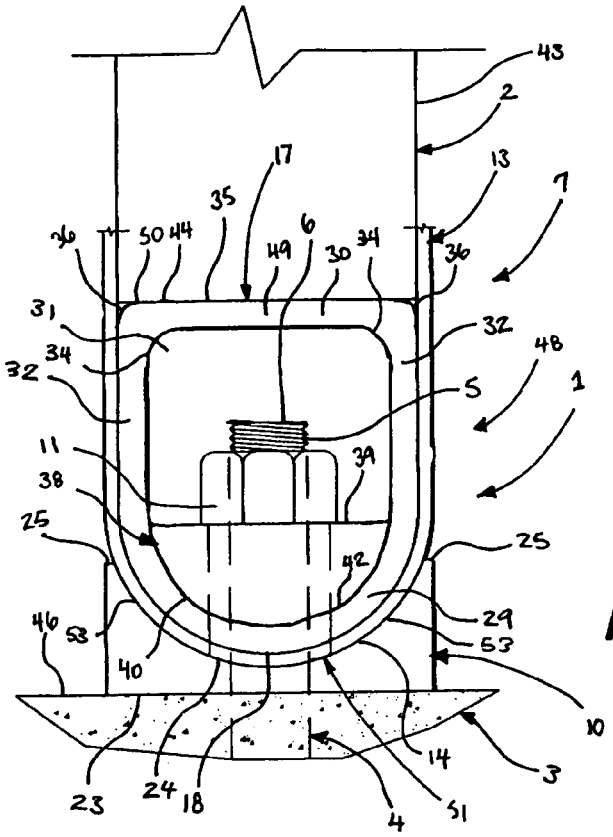
FIG. 15A is an enlarged front elevation view of the connector of the present invention showing the standoff base inserted into the strap without any rotation.
Figure 15B:
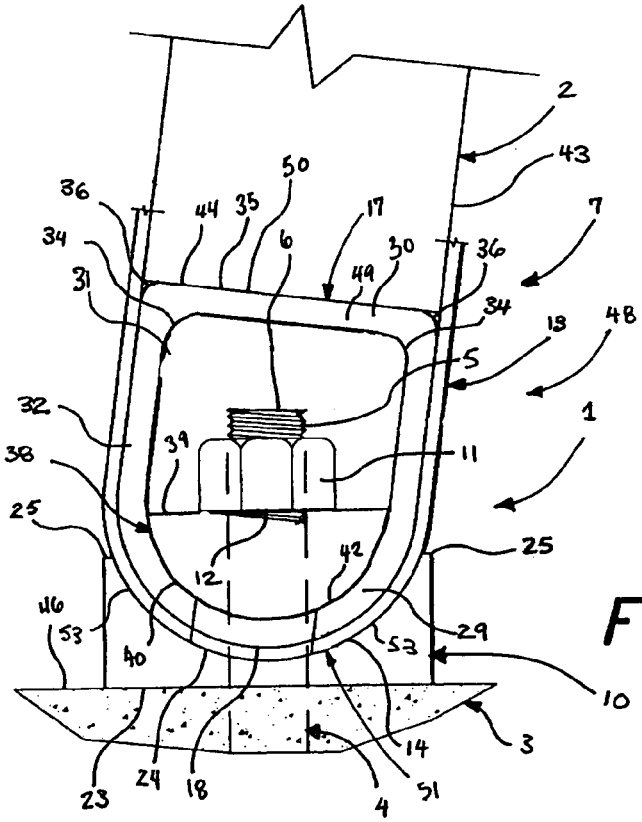
FIG. 15B is an enlarged front elevation view of the connector of the present invention showing rotation about an axis.

The first standoff member 49 includes a first bearing surface 50 that supports the first building structural member 2 above the second building structural member 3. The first anchor attachment member 11 interfaces with the first anchor member 4 and restrains the first anchor member 4 from withdrawing from the connector 7. The bottom portion 51 includes a first anchor member opening 52, as shown in FIG. 14, through which the first end portion 5 of the first anchor member 4 passes, and first and second tapered portions 53 that narrow the connector 7 toward the first anchor member opening 52, the first and second tapered portions 53 together tapering at least one quarter the width 45 of the bottom end 44 of the first building structural member 2 such that the bottom portion 51 of the connector 7 can rotate relative to the second building structural member 3. The bottom portion 51 must be sufficiently tapered to allow rotation. If the bottom portion 51 has less taper, the bottom portion 51 will resist rotation too much and the bottom portion 51 will pry up against the lower corners that will be formed if the taper is lessened or absent; the corners will in turn push down on the underlying second building structural member 3 and will tend to crack or break it, in particular if it is a concrete foundation 3 as preferred.

In contrast, the axis of rotation 12 of a prior art holdown connector 7 would occur at some point above the bearing surface 50, even in prior art holdown connectors 7 that are designed to permit rotation, and above the structural attachment member 8 in prior art concentric holdown connectors 7 that are not designed to permit rotation.

As shown in FIGS. 1A, 1B, 10 and 15A-19, in preferred embodiments, the connection 1 preferably further includes a support base 10 including a first support surface 22, located between the connector 7 and the second building structural member 3 and which supports the connector 7, and an anchor member opening 21 through which the first end portion 5 of the anchor member 4 passes. The support base 10 is best shown in FIGS. 3-6.

Preferably, the first and second tapered portions 53 of the connector 7 are substantially arcuate. Preferably the first support surface 22 of the support base 10 conforms to the first and second tapered portions 53 of the connector 7. Preferably, the bottom portion 51 of the connector 7 slides on the first support surface 22 of the support base 10 when the connector 7 rotates relative to the second building structural member 3.

As shown in FIGS. 1A, 1B, 10 and 15A-19, preferably, the first structural attachment member 8 and the bottom portion 51 of the connector 7 are parts of a channel 13 including a base 14, with an anchor opening 16, and two sides 15, the channel 13 additionally including a second structural attachment member 8, the first and second structural attachment members 8 being the two sides 15 of the channel 13 and the bottom portion 51 of the connector 7 being the base 14 of the channel 13.

Preferably, the first standoff member 49 is part of a separate standoff base 17, further including a substantially arcuate bottom 18, the bottom 18 of the standoff base 17 being formed to be received between the sides 15 of the channel 13 and resting on the base 14 of the channel 13, the standoff base 17 being formed with an opening 19 for receiving the first anchor member 4, the standoff base 17 being connected to the anchor member 4 by the first anchor attachment member 11. The standoff base is best shown in FIGS. 11-14.

Preferably, the first building structural member 2 is received between the sides 15 of the channel 13 and the bottom end 44 of the first building structural member 2 rests on the first bearing surface 50 of the standoff base 49. Preferably, fasteners 28 connect the two sides 15 of the channel 13 to the first building structural member 2. Preferably, the support base 10 is a plate 10 additionally including a flat bottom 23 that rests on the upper surface 46 of the second building structural member 3.

Preferably, the channel 13 is a strap 13 and the sides 15 of the channel 13 each additionally includes an end 26 and a plurality of fastener openings 27. Preferably, the standoff base 17 additionally includes a lower portion 29, an upper portion 30, and an open portion 31 between the lower portion 29 and the upper portion 30. Preferably, the open portion 31 of the standoff base 17 includes two sides 32 that connect the lower portion 29 and the upper portion 30. The channel 13 is best shown in FIGS. 7-9 and 20-25.

Preferably, the first building structural member 2 is a wall stud 2. Preferably, the second building structural member 3 is a concrete foundation 3.

Figure 20:
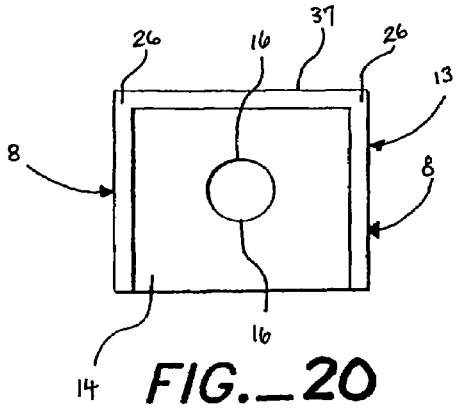
FIG. 20 is a top plan view of the channel of the connector of the present invention having a back member.
Figure 21:
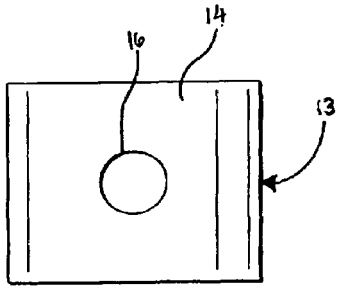
FIG. 21 is a bottom plan view of the channel of the connector of the present invention having a back member
Figure 22:
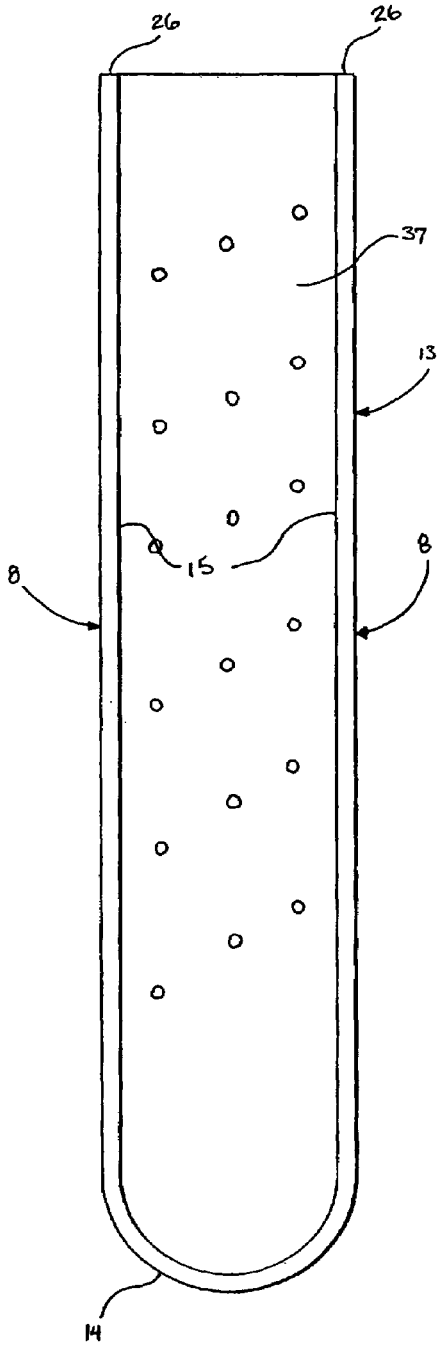
FIG. 22 is a front elevation view of the channel of the connector of the present invention having a back member.

As best shown in FIGS. 20-22, in an alternate embodiment, the channel 13 preferably further includes a back member 37 joining the two sides 15, and the first building structural member 2 interfaces with the back member 37. Preferably, fasteners 28 connect the back member 37 to the first building structural member 2.

As in the other preferred embodiments, in the most preferred embodiment the first and second tapered portions 53 of the connector 7 are substantially arcuate.

Preferably, the first structural attachment member 8 and the bottom portion 51 of the connector 7 are parts of a channel 13 including a base 14, with an anchor opening 16, and two sides 15, the channel 13 additionally including a second structural attachment member 8, the first and second structural attachment members 8 being the two sides 15 of the channel and the bottom portion 51 of the connector 7 being the base 14 of the channel 13.

Preferably, the first standoff member 49 is part of a separate standoff base 17, further including a substantially arcuate bottom 18 and a substantially arcuate inner bottom surface 42, the bottom 18 of the standoff base 17 being formed to be received between the sides 15 of the channel 13 and resting on the base 14 of the channel 13, the standoff base 17 being formed with an opening 19 for receiving the anchor member 4, the standoff base 17 being connected to the anchor member 4 by the first anchor attachment member 11.

Figure 17:
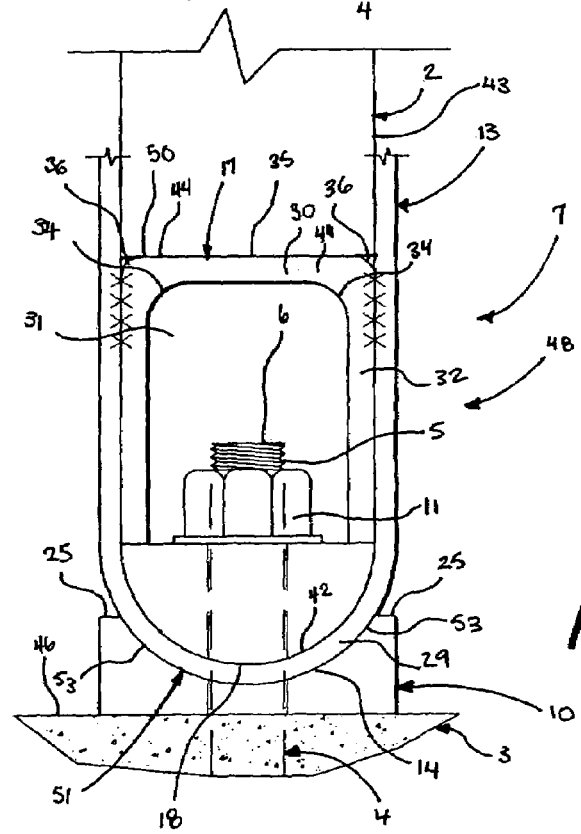
FIG. 17 is an enlarged front elevation view of the connector of the present invention showing the standoff base inserted into the strap without any rotation.
Figure 18:
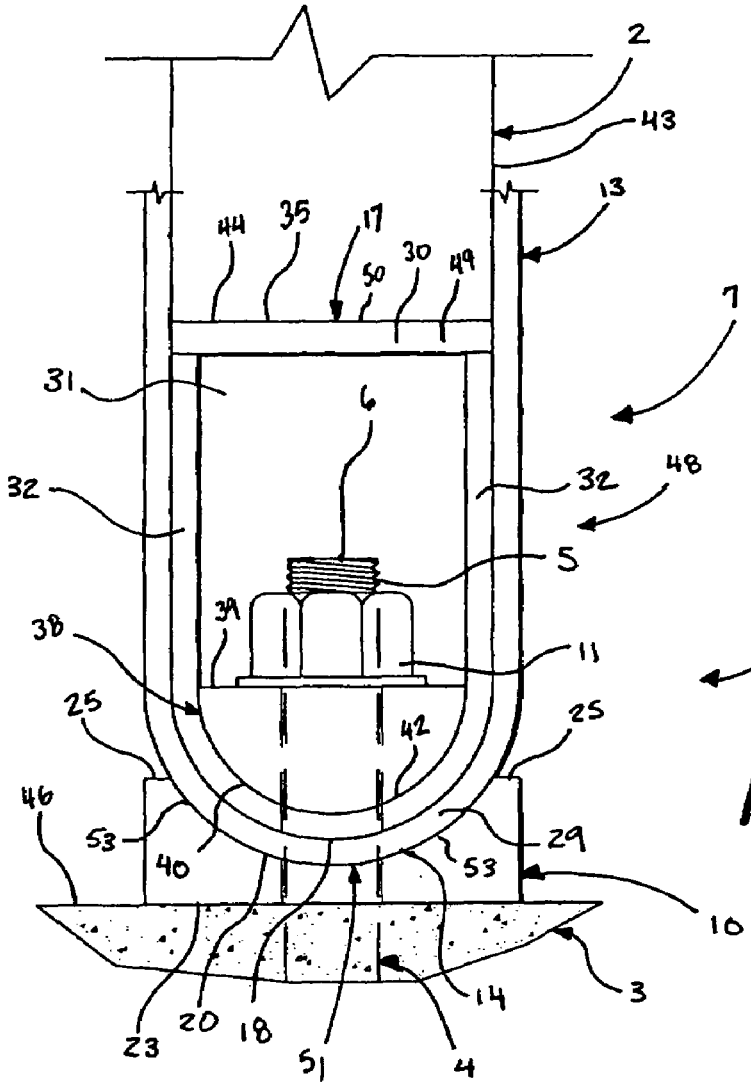
FIG. 18 is an enlarged front elevation view of the connector of the present invention showing the standoff base inserted into the strap without any rotation.

As shown in FIGS. 1A, 1B, 10, 15A-15B and 18-19, preferably, the connector 7 further includes a floating washer member 38 that rests on the substantially arcuate inner bottom surface 42 of the standoff base 17 above the opening 19 in the standoff base 17, the floating washer member 38 including a top surface 39 and a bore 41. The anchor member 4 preferably passes through the opening 19 in the standoff base 17 and the bore 41 in the floating washer member 38. As shown in FIGS. 17 and 18, the less preferred embodiments do not have a floating washer 38.

Preferably, the connection 1 further includes a support base 10 including a first support surface 22 that supports the connector 7 and an anchor member opening 21 through which the first end portion 5 of the anchor member 4 passes.

Preferably, the first support surface 22 of the support base 10 conforms to the first and second tapered portions 53 of the connector 7. Preferably, the bottom portion 51 of the connector 7 slides on the first support surface 22 of the support base 10 when the connector 7 rotates relative to the second building structural member 3.

As shown in FIGS. 1A, 1B, 10, 15A-15B and 18-19, preferably, the floating washer member 38 additionally includes a substantially arcuate bottom surface 40 that interfaces with and rests on the substantially arcuate inner bottom surface 42 of the standoff base 17, and the bore 41 in the floating washer member 38 joins the top surface 39 and the bottom surface 40 of the floating washer member 38.

Preferably, the opening 19 in the standoff base 17 and the opening 16 in the channel 13 are larger than the anchor member 4, allowing the standoff base 17, the channel 13 and the first building structural member 2 to rotate relative the second building structural member 3 while the floating washer member 38 remains level.

Preferably, the first building structural member 2 is received between the sides 15 of the channel 13 and the bottom end 44 of the first building structural member 2 rests on the first bearing surface 50 of the standoff base 17.

Preferably, fasteners 28 connect the two sides 15 of the channel 13 to the first building structural member 2. Preferably, the support base 10 is a plate 10 additionally including a bottom 23 that rests on the upper surface 46 of the second building structural member 3. Preferably, the channel 13 is a strap 13 and the sides 15 of the channel 13 each additionally include an end 26 and a plurality of fastener openings 27.

Preferably, the standoff base 17 additionally includes a lower portion 29 occupied by the floating washer 38, an upper portion 30, and an open portion 31 between the lower portion 29 and the upper portion 30. Preferably, the open portion 31 of the standoff base 17 includes two sides 32 that connect the lower portion 29 and the upper portion 30.

Preferably, the first building structural member 2 is a wall stud 2. Preferably, the second building structural member 3 is a concrete foundation 3.

In an alternate embodiment, the channel 13 preferably further includes a back member 37 joining the two sides 15, and the first building structural member 2 interfaces with the back member 37. Preferably, fasteners 28 connect the back member 37 to the first building structural member 2.

Preferably, the first support surface 22 of said support base 10 conforms to the bottom portion 51 of the connector 7. If the bottom portion 51 is curved, the support surface 22 will have a matching curvature. If the bottom portion 51 has flat portions, the support surface will have matching flat portions. Preferably, the first support surface 22 of the support base 10 forms a concavity 24 that cradles the bottom portion 51 of the connector 7.

Preferably, if the supported post 2 is a double 2×4 stud, the support base 10 is a metal plate that has a flat bottom 23 and a substantially arcuate first support surface 22 that is ¾" thick at a minimum, forming a concavity 24. The concavity 24 is an arc preferably with a radius of 1¾". Preferably, the support base 10 is 3½" long and 3" wide and has an anchor member opening 21 that is 15/16" in diameter and centered in the concavity 24. Preferably, there are two flat portions 25 on either side of the concavity 24 and these are preferably ¼" wide. The support base 10 is preferably steel or cast aluminum.

Preferably, if the supported post 2 is a double 2×4 stud 2, the channel 13 is a U-shaped strap 13 with a base 14 that fits snugly between the concavity 24 of the support base 10 and the substantially arcuate bottom 18 of the standoff base 17. The channel 13 is preferably a length of 3-gauge sheet steel with two sides 15 that stand 18¼" tall from the lowest point of the substantially arcuate bottom 18 to the ends 26 of the sides 15 of the channel 13. Preferably, it is 3" wide and its sides 15 are spaced 3" apart. Preferably, its substantially arcuate bottom 18 has an outside radius of 1¾". Preferably, both of the sides 15 of the channel 13 have a plurality of fastener openings 27, preferably beginning 7⅛" from the lowest point of the channel 13 and continuing substantially all the way up the sides 15. The sides 15 are preferably attached to the first structural member 2 with a plurality of mechanical fasteners 28, preferably self-drilling wood screws, but also possibly other types of screw, nails or bolts. The sides 15 might also be attached to the first structural member 2 using chemical bonds or adhesives.

As shown in FIGS. 1A, 1B, 10, 15A-15B and 18-19, in the most preferred form of the invention, if the supported post 2 is a double 2×4 stud 2, the standoff base 17 is preferably a single piece of cast aluminum, although it can also be made of other metals or composites, and can be a multipart component. The standoff base 17 is preferably 3" long and 3" wide, with a lower portion 29 that has a substantially arcuate bottom 18 and a centered vertical opening 19 for receiving the first anchor member 4. The curve of the substantially arcuate bottom 18 preferably has a radius of 1½". The opening 19 for receiving the first anchor member 4 is preferably slotted, the slot being 1³⁄₁₆" long and ¹⁵⁄₁₆" wide. Preferably, the standoff base 17 has an upper portion 30 separated from the lower portion 29 by an open portion 31 that has two sides 32 that connect the lower portion 29 and the upper portion 30. The open portion 31 is preferably 2½" tall and has upper rounded corners 34 with radii of ½". The upper portion 30 is preferably ⅜" thick. Preferably, the standoff base 17 has a top surface 35 that has two rounded side edges 36 with radii of ¼". Preferably, the standoff base 17 has a substantially arcuate inner bottom surface 42 with a radius of 1¼". Preferably, the lower portion 29 of the standoff base 17 is occupied by a floating washer member 38 which has a top surface 39 that is 2¼" wide, a bottom surface 40 with a radius of 1¼" that matches the radius of the substantially arcuate inner bottom surface 42 on which it rests. The floating washer member 38 preferably has a bore 41 that connects the top surface 39 and the bottom surface 40; the bore 41 preferably has a diameter of ¹⁵⁄₁₆" to accommodate a first anchor member 4 of matching diameter.

Figure 16:
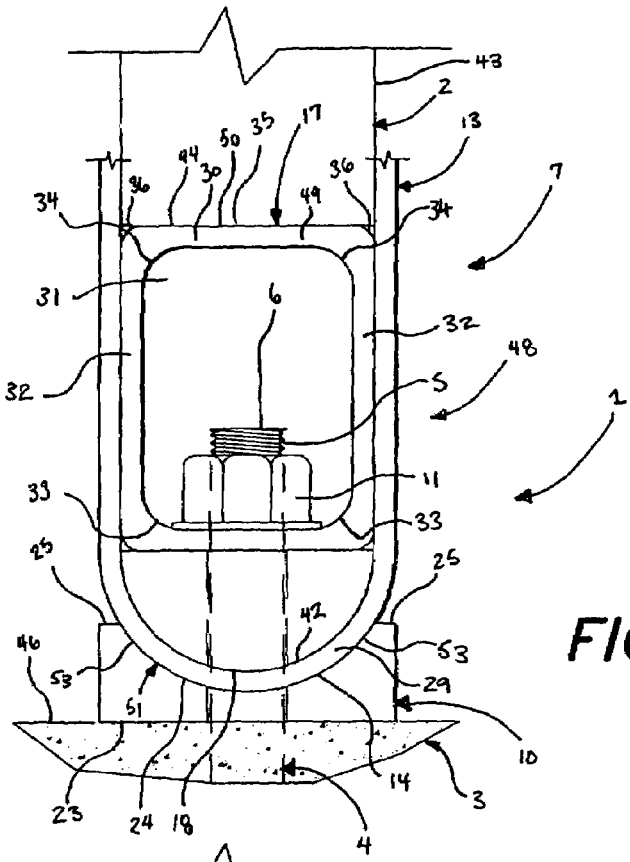
FIG. 16 is an enlarged front elevation view of the connector of the present invention showing the standoff base inserted into the strap without any rotation.

Alternate preferred embodiments are shown in FIGS. 16 and 17. In the alternate preferred embodiments, there is no floating washer member 38 but rotation is still possible. In the alternate preferred embodiment shown in FIG. 16, the standoff base 17 is a square tube section and an underlying solid half cylinder, both steel, although it can also be made of other metals or composites, and can be a single piece or a multipart component. The standoff base 17 is preferably 3" long and 3" wide, with a lower portion 29 that has a substantially arcuate bottom 18 and a centered vertical opening 19 for receiving the first anchor member 4. The curve of the substantially arcuate bottom 18 preferably has a radius of 1½". The opening 19 for receiving the first anchor member 4 is preferably ⁵⁄₁₆" in diameter. Preferably, the standoff base 17 has an upper portion 30 separated from the lower portion 29 by an open portion 31 that has two sides 32 that connect the lower portion 29 and the upper portion 30. The open portion 31 is preferably 2½" tall, has lower rounded corners 33 with radii of ¼" as shown in FIG. 16, and has upper rounded corners 34 with radii of ½". The upper portion 30 is preferably ⅜" thick. Preferably, the standoff base 17 has a top surface 35 that has two rounded side edges 36 with radii of ¼".

As shown in FIGS. 1A, 1B, 10, 15A-15B and 18-19, in the most preferred embodiment, all of the connector 7, other than the floating washer member 38, and the first building structural member 2 are allowed to rotate while the floating washer member 38 remains level. This has substantial advantages over the alternate preferred embodiments that do not have the floating washer member 38 because it allows the connector 7 to rotate smoothly about an axis of rotation 12 approximately centered on the top surface 39 of the floating washer member 38. In all embodiments of the present invention, the connector 7 rotates on an axis of rotation 12 that is below the first end 6 of the first anchor member 4, approximately at the first anchor attachment member 11. In prior art connections, a prying moment is imposed by uplift on the first anchor member 4, elongating it by stretching and bending it when the connector 7 attempts to rotate. The present invention with its floating washer member 38 are preferable because, even if the first anchor member 4 is infinitely, and theoretically, ductile, the whole connection 1 will be loosened if the first anchor member 4 is stretched.

In the preferred form, the connector 7 of the present invention is used to connect a first building structural member 2, which can be a double wall stud or post 2 made from two nominal 2×4 lengths of lumber, to a second building structural member 3, which is preferably a concrete foundation 3. The first anchor member 4 is preferably a steel anchor bolt 4 embedded in the concrete foundation. Preferably, the first end portion 5 of the anchor bolt 4 is threaded. The anchor bolt 4 preferably passes through the anchor member opening 21 in the support base 10, through the anchor opening 16 in the base 14 of the channel 13, and through the opening 19 in the lower portion 29 of the standoff base 17. In the preferred form, the anchor attachment member 11 is a nut 11 that is turned down over the threaded first end portion 5 of the anchor bolt 4. The open portion 31 allows the nut 11 to be turned down and tightened on the threaded first end portion 5 of the anchor bolt 4. Alternatively, the anchor attachment member 11 could be a pin 11 that passes through the anchor bolt 4 or the anchor attachment member 11 could be a weld 11 that either closes off the first end 6 of the anchor member 4 or that joins the first end portion 5 of the anchor member 4 to the connector 7.

As shown in FIG. 16, in a first alternate preferred embodiment the standoff base 17 is a two-piece steel member, in which the lower portion 29 is a half-cylinder washer plate and the open portion 31 and upper portion 30 are a tube section 4" tall, 3" wide, with ¼" thick walls.

As shown in FIG. 17, in a second alternate preferred embodiment the standoff base 17 is a two-piece steel member, in which the lower portion 29 is a half-cylinder washer plate and the open portion 31 and upper portion 30 are an inverted U cap, ⁵⁄₁₆" thick, welded to the sides 15 of the channel 13 just below the upper portion 30.

As shown in FIG. 18, in a third alternate preferred embodiment, the standoff base 17 is a 3-gauge U-plate that also forms the sides 32 of the open portion 31. The sides 32 of the open portion 31 support a ⁵⁄₁₆" cap plate that forms the upper portion 30 of the standoff base 17. A floating washer member 38 is held within the 3-gauge U-plate.

In another alternate embodiment, shown in FIGS. 20-22, the sides 15 of the channel 13 are joined by a back member 37 and the back member 37 and the sides 15 interface with the first building structural member 2.

It may be desirable to coat the curved slip planes between the support base 10 and the channel 13 and between the standoff base 17 and the floating washer 38, and the coating could be a dry or liquid lubricant, metal bearing liners, Teflon fabric bearing liners, or the like.

We claim:

1. A building connection (1) comprising:

a. a first building structural member (2) further including a first side face (43) and a bottom end (44), said bottom end (44) having a width (45);

b. a second building structural member (3) including an upper surface (46) that supports said first building structural member (2);

c. a first anchor member (4), restrained by said second building structural member (3), said first anchor member (4) further including a first end portion (5) extending from said second building structural member (3) and a first end (6);

d. a connector (7) that receives said first end portion (5) of said first anchor member (4), said connector (7) including:

i. an upper portion (47) comprising a first structural attachment member (8), said first structural attachment member (8) including a first side (15) that is attached to said first side face (43) of said first building structural member (2);

ii. a lower portion (48), at least partially located between said bottom end (44) of said first building structural member (2) and said upper surface (46) of said second building structural member (3), including:

(a) a first standoff member (49), said first standoff member (49) including a first bearing surface (50) that supports said first building structural member (2) above said second building structural member (3);

(b) a first anchor attachment member (11), said first anchor attachment member (11) interfacing with said first anchor member (4) and restraining said first anchor member (4) from withdrawing from said connector (7); and (c) a bottom portion (51) located between said bottom end (44) of said first building structural member (2) and said upper surface (46) of said second building structural member (3) and not extending beyond said width (45) of said bottom end (44) of said first building structural member (2), said bottom portion (51) comprising a first anchor member opening (52) through which said first end portion (5) of said first anchor member (4) passes, and first and second tapered portions (53) that narrow said connector (7) toward said first anchor member opening (52), said first and second tapered portions (53) together tapering at least one quarter said width (45) of said bottom end (44) of said first building structural member (2) such that said bottom portion (51) of said connector (7) can rotate relative to said second building structural member (3); and wherein;

e. said connection (1) has an axis of rotation (12) and said axis of rotation (12) is below said first end (6) of said first anchor member (4);

f. said first and second tapered portions (53) of said connector (7) are substantially arcuate;

g. said first structural attachment member (8) and said bottom portion (51) of said connector (7) are parts of a channel (13) comprising a base (14), with an anchor opening (16), and two sides (15), said channel (13) additionally including a second structural attachment member (8), said first and second structural attachment members (8) being said two sides (15) of said channel and said bottom portion (51) of said connector (7) being said base (14) of said channel (13); and h. said first standoff member (49) is part of a separate standoff base (17), further comprising a substantially arcuate bottom (18) and a substantially arcuate inner bottom surface (42), said bottom (18) of said standoff base (17) being formed to be received between said sides (15) of said channel (13) and resting on said base (14) of said channel (13), said standoff base (17) being formed with an opening (19) for receiving said anchor member (4) therethrough, said standoff base (17) being connected to said anchor member (4) by said first anchor attachment member (11); and i. said connector (7) further includes a floating washer member (38) that rests on said substantially arcuate inner bottom surface (42) of said standoff base (17) above said opening (19) in said standoff base (17), said floating washer member (38) comprising a top surface (39) and a bore (41); wherein:

i. said anchor member (4) passes through said opening (19) in said standoff base (17) and said bore (41) in said floating washer member (38).

2. The connection (1) of claim 1 further comprising:

a. a support base (10) comprising a first support surface (22) that supports said connector (7) and an anchor member opening (21) through which said first end portion (5) of said anchor member (4) passes.

3. The connection (1) of claim 2 wherein:

a. said first support surface (22) of said support base (10) conforms to said first and second tapered portions (53) of said connector (7).

4. The connection (1) of claim 3 wherein:

a. said bottom portion (51) of said connector (7) slides on said first support surface (22) of said support base (10) when said connector (7) rotates relative to said second building structural member (3).

5. The connection (1) of claim 4 wherein:

a. said floating washer member (38) additionally comprises a substantially arcuate bottom surface (40) that interfaces with and rests on said substantially arcuate inner bottom surface (42) of said standoff base (17), and said bore (41) in said floating washer member (38) joins said top surface (39) and said bottom surface (40) of said floating washer member (38).

6. The connection (1) of claim 5 wherein:

a. said opening (19) in said standoff base (17) and said opening (16) in said channel (13) are larger than said anchor member (4), allowing said standoff base (17), said channel (13) and said first building structural member (2) to rotate relative said second building structural member (3) while said floating washer member (38) remains level.

7. The connection (1) of claim 6 wherein:

a. said first building structural member (2) is received between said sides (15) of said channel (13) and said bottom end (44) of said first building structural member (2) rests on said first bearing surface (50) of said standoff base (17).

8. The connection (1) of claim 7 wherein:

a. fasteners (28) connect said two sides (15) of said channel (13) to said first building structural member (2).

9. The connection (1) of claim 8 wherein:

a. said support base (10) is a plate (10) additionally comprising a bottom (23) that rests on said upper surface (46) of said second building structural member (3).

10. The connection (1) of claim 9 wherein:

a. said channel (13) is a strap (13) and said sides (15) of said channel (13) each additionally comprise an end (26) and a plurality of fastener openings (27).

11. The connection (1) of claim 10 wherein:

a. said standoff base (17) additionally comprises a lower portion (29) occupied by said floating washer (38), an upper portion (30), and an open portion (31) between said lower portion (29) and said upper portion (30).

12. The connection (1) of claim 11 wherein:

a. said open portion (31) of said standoff base (17) comprises two sides (32) that connect said lower portion (29) and said upper portion (30).

13. The connection (1) of claim 12 wherein:

a. said first building structural member (2) is a wall stud (2).

14. The connection (1) of claim 13 wherein:

a. said second building structural member (3) is a concrete foundation (3).

15. The connection (1) of claim 1 wherein:

a. said channel (13) further comprises a back member (37) joining said two sides (15); and b. said first building structural member (2) interfaces with said back member (37).

16. The connection (1) of claim 15 wherein:

a. fasteners (28) connect said back member (37) to said first building structural member (2).

* * * * *